United States Patent [19]

Chang

[11] Patent Number: 4,724,885

[45] Date of Patent: Feb. 16, 1988

[54] SEMI-AUTOMATIC SHUTTER SLAT ORIENTATION ADJUSTMENT AND DRAPE RELEASE CONTROL AS APPLIED IN A DOUBLE-LAYER WINDOW DRAPE COMPATIBLE WITH VENETIAN BLIND SLATS

[76] Inventor: A-Shen Chang, No. 6, Lane 722, Yen Hai Rd., Fu Nan Ts'un, Fu Hsing Hsiang, Changhua Hsien, Taiwan

[21] Appl. No.: 935,801

[22] Filed: Nov. 28, 1986

[51] Int. Cl.[4] ..... E06B 3/32

[52] U.S. Cl. ..... 160/89; 160/176 R

[58] Field of Search ..... 160/89, 108, 127, 128, 160/176 R, 241, 120, 113, 114, 115

[56] References Cited

U.S. PATENT DOCUMENTS

| | | | |
|---|---|---|---|
| 879,218 | 2/1908 | Tickerhoof | 160/120 X |
| 1,522,352 | 1/1925 | Wertheimer | 160/120 X |
| 1,782,954 | 11/1930 | Bauer | 160/89 |
| 2,140,080 | 12/1938 | Johnson | 160/108 |
| 2,647,572 | 8/1953 | Biscoe et al. | 160/115 |
| 2,702,081 | 2/1955 | North et al. | 160/120 |
| 4,621,672 | 11/1986 | Hsu | 160/176 R X |

FOREIGN PATENT DOCUMENTS

| | | | |
|---|---|---|---|
| 251856 | 1/1967 | Austria | 160/108 |
| 1042800 | 9/1966 | United Kingdom | 160/89 |

*Primary Examiner*—Ramon S. Britts
*Assistant Examiner*—David M. Purol
*Attorney, Agent, or Firm*—Browdy and Neimark

[57] ABSTRACT

A semi-automatic shutter slat orientation adjustment and drape release control as applied in double-layer window drape compatible with Venetian blind slat; in more specific terms a composite structure of a blind, be it vertical or horizontal in execution, with a drape in a common tringle or top rail confined in a double rail guide, so that it makes possible switching selection of frontal or rear settings by means of a pair of opposing bevel gears with a single sliding sleeve that is driven by a ball chain carried in a support wheel. Under normal conditions, the sleeve, once acted upon by a compression spring behind it, will bring the frontal side of a composite bevel gear into engagement with the transmission bevel gear for the drape roller, thereby achieving release control of the drape sections, whilst orientation adjustment of the Venetian blind is performed by withdrawing the sleeve with the ball chain, to result in bringing the composite bevel gear into engagement with a transmission bevel gear provided on the orientation adjustment shaft for the Venetian blind.

4 Claims, 6 Drawing Figures

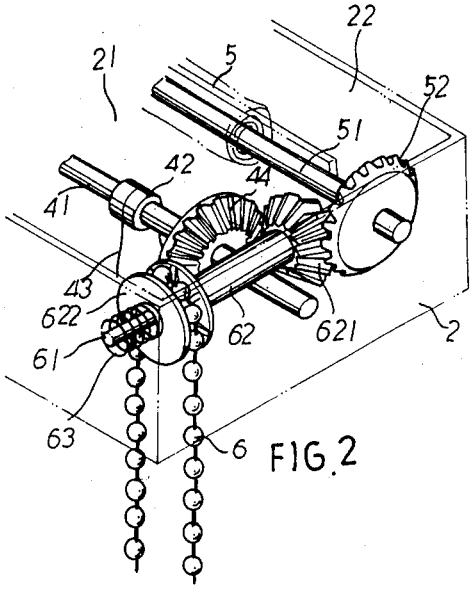
FIG. 2
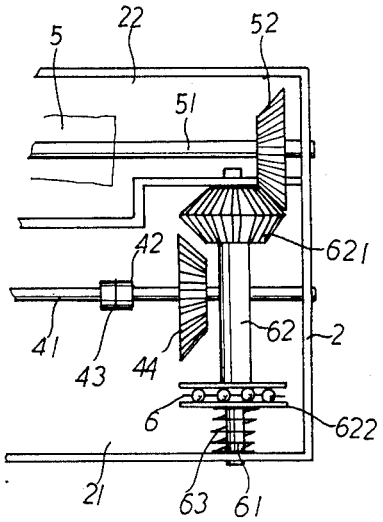
FIG. 3-A
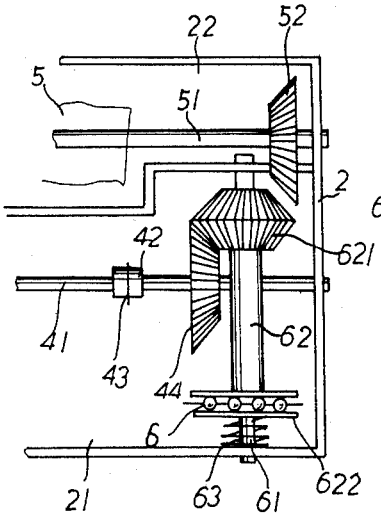
FIG. 3-B
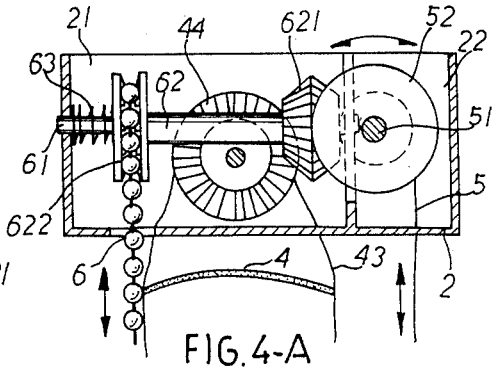
FIG. 4-A
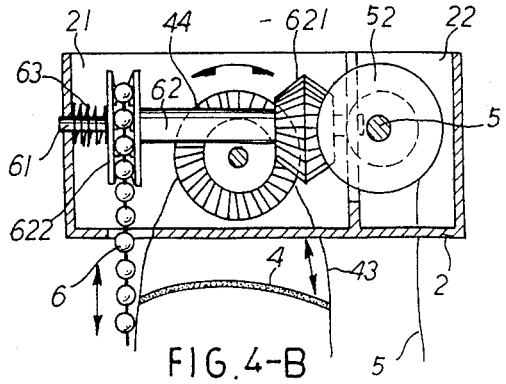
FIG. 4-B

SEMI-AUTOMATIC SHUTTER SLAT ORIENTATION ADJUSTMENT AND DRAPE RELEASE CONTROL AS APPLIED IN A DOUBLE-LAYER WINDOW DRAPE COMPATIBLE WITH VENETIAN BLIND SLATS

FIELD OF THE INVENTION

A semi-automatic shutter slat orientation adjustment and drape release control as applied in double-layer window drape compatible with Venetian blind.

BACKGROUND OF THE INVENTION

A basic element for stylish living calls for optimum coordination between harmony and privacy in respect to the exposure to sunshine and conversely, protection from unwanted exposure to sunshine, to unwanted observation from a position outdoors, where the design of a living room or office is concerned. That is why it has become fashionable to employ the "double-layer" mode of design for Venetian blinds or window drapery for installation in a tasteful piece of housing. By the term "double-layer", reference is made to a regular Venetian blind, be it vertical or horizontal for execution, supplemented by a whole piece of window drapery side-by-side. The drapery is fitted further indoors, so that if and when it is intend to shade out sunshine completely, the blind is put down entirely, with the slats adjusted straight in the upstanding position, and the sunshine is kept out. But if it is then intended further to dim out light penetration, the drapery within can be pulled down to absorb and therefore keep out in full the light penetration, however small it might be, whereas illumination indoors can be adjusted solely with respect to the illumination facilities indoors. This arrangement not only eliminates the permeation of sunshine still prevailing where Venetian blind or window drapery alone is provided indoors, but also helps to block external noises, plus the additional advantage of tranquility and embellishing effects realized by virtue of pattern decor to be employed on the surface of the drapery.

In common practice, the preparation of so-called double-layer window drapery calls for separate installation, the drapery and the Venetian blind being structurally independent of each other, so that it is not infrequent to see fittings, locking bolts or brackets conflicting with each other as the installation is in progress, and even upon completion of the installation. The worst comes when it becomes extremely difficult to go ahead with the installation, or installation managed with inevitable deformations. Furthermore, the top rail and control being designed independent of each other, means not only a waste of structural economy, but also gross waste of labor involved in the installation. Moreover, it is rather complicated for use. All these explain why conventional composite blind-drapery window settings are far from being extensively accepted by the mass of consumers, in spite of its shading performance that is desirable.

SUMMARY OF THE INVENTION

Accordingly, a prime object of the present invention, is to provide for the structure of a semi-automatic shutter slat orientation adjustment and drape release control as applied in a double-layer window drape compatible with Venetian blind slats, which embodies altogether the blind slat orientation adjustment with the drapery release/withdrawal on a common transmission shaft; and incorporates a mechanism to permit switching from the drapery release/withdrawal to slat orientation by rearward pull of a ball chain, thereby achieving duplex control execution.

A further object of the present invention lies in the provision of the structure of a semi-automatic shutter slat orientation adjustment and drape release control as applied in double-layer window drape compatible with Venetian blind slats, which incorporates synchronized control of the blind and drapery, thereby achieving simplification of structural logic, which means a substantial saving up to half the structural cost, and at the same time makes possible an offer of the best possible product at a reasonably low price to consumers who are concerned about niceties in lifestyle.

A further object of the present invention is to provide for the structure of a semi-automatic shutter slat orientation adjustment and drape release control as applied in double-layer window drape compatible with Venetian blind slats, which makes possible the installation on a single rail, thereby promoting installation precision impossible with conventional double-railing executions.

In accordance with above objects, the present invention comprises a composite structure of a blind, be it vertical or horizontal in execution, with a drape in a common tringle or top rail confined in a double rail guide, so that it makes possible switching selection of frontal or rear settings by means of a pair of opposing bevel gears with a single sliding sleeve that is driven by a ball chain as carried in a support wheel. Under normal conditions the sleeve, once acted upon by a compression spring behind it, will bring the frontal side of a composite bevel gear into engagement with the transmission bevel gear for the drape roller thereby achieving release control of the drape sections, whilst orientation adjustment of the Venetian blind is performed by withdrawing the sleeve with the ball chain, to result in bringing the composite bevel gear into engagement with a transmission bevel gear provided on the orientation adjustment shaft for the Venetian blind.

BRIEF DESCRIPTION OF THE DRAWINGS

Other features and advantages of the present invention will emerge from the following descriptions of embodiments given by way of illustration, but not in any way limiting with reference to the accompanying drawings in which:

FIG. 2 is a perspective view of the control mechanism of the composite structure of FIG. 1;

FIG. 3A is an operational illustration of the control mechanism of FIG. 2 acting upon the drapery, rolled up or upon release;

FIG. 3B is an operational illustration of the control mechanism of FIG. 2 acting upon the slat orientation;

FIG. 4A is a side view operational illustration of the control mechanism of FIG. 3A acting upon the drapery, rolled up or upon release; and FIG. 4B is another side view operational illustration of the control mechanism of FIG. 3B acting upon the slat orientation.

DETAILED DESCRIPTION OF THE PREFERRED EMBODIMENT

Figure 1:
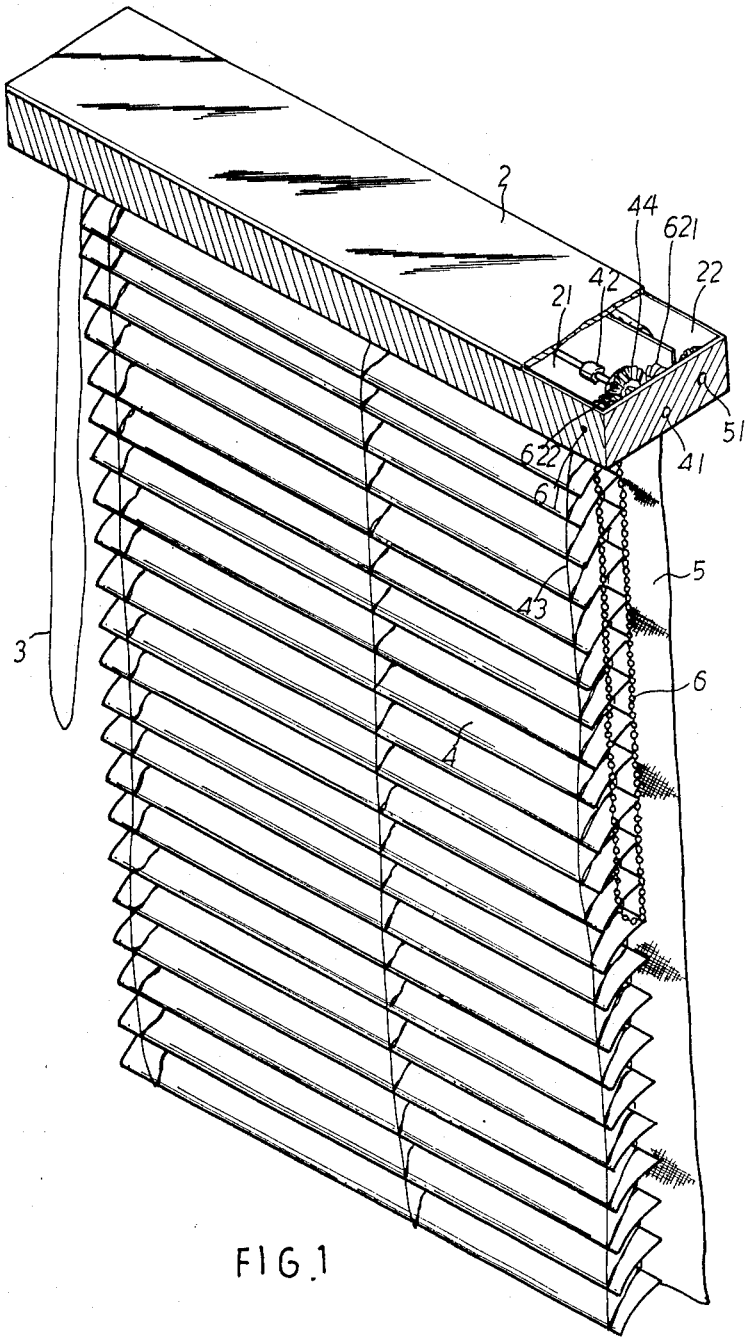
FIG. 1 is a perspective view of a composite Venetian blind/window drapery shade embodied on a common top rail of the present invention.

Referring first of all to FIG. 1, it is seen that the invention comprising a tringle, otherwise referred to as top rail 2, fitted upon twin guideways 21, 22, provides for the installation of a set of Venetian blind and roller drapery, laying side by side, to be used either separately or jointly, both subject to easy adjustment control by the actuation of a pull rope 3, and where of conventional structure, the description thereof is omitted, whereby the blind slats can be pulled up in a neat, uptight group if need be, and whereas adjustment of the orientation of the slats 4 and the release of drapery 5 are performed by lateral pull or down pull of a bead chain 6, these being characteristic under the present invention, because these adjustments can be made very easily without much ado. As regards the construction and positional correlation of the components, reference is called to FIG. 2, from which it is seen that the level middle section of guideway 21 provides for the cross support of slat orientation adjustment shaft 41, together with a number of journal couplings 42, one for either side section and one for either side of the middle section. The journal coupling 42 accommodates pendant fittings of trapezoidal lacing 43, which brings a series of slats 4 to form the blind shutter. Transmission of the lacing 43 by the slat orientation adjustment shaft 41, serves to bring all the slats to the orientation desired. The means receiving pivoting drive from the orientation shaft 41 is a bevel gear 44 mounted broadside on the shaft 41. The level middle section of another guideway 22 provides for the parallel setting of drapery roller 51, so that a broad drape 5 attached to the roller 51 may unroll and extend downwards, to roll up or else be released in response to pivoting transmission in one direction or the opposite respectively, thus forming the entire drapery front.

The means to rotate the drapery roller 51 is a bevel gear 52 that is mounted on the roller 51, the broadside of the bevel gear 52, sufficient to accommodate engagement, is provided in guideway 21. Opposite the toothed front of bevel gear 44, on the side provided with guideway 21, for the orientation adjustment shaft 41, there is also provided, in the longitudinal direction, a shaft 61, to facilitate coupling, and therefore sliding of a sleeve 62 thereon. At the head of the sleeve 62, there is mounted a composite bevel gear 621 to facilitate alternative engagement with either bevel gear 52 or 44 by taking advantage of the longitudinal sliding of sleeve 62. On the hindside of sleeve 62 is mounted a bead chain hanging wheel 622, serving to accommodate the setting of recycling bead chain 6 and the pendent setting of the remainder of such a recycling bead chain 6 when pulled about wheel 622 in use. Transmission of the chain 6 by a pull on it serves to drive sleeve 62.

On the shaft 61 supporting hanging wheel 622, on the hindside, there is advantageously mounted an annular compression spring 63 which, in the normal state, will push the sleeve 62 inwards to bring the frontal side of composite bevel gear 621 in engagement with the bevel gear 52 integral with roller 51, so that exertion of a pull straight down the bead chain 6 will bring about a choice, in the forward or in the reverse direction, resulting respectively in either rolling up or release of drapery 5, as can be better seen in FIG. 3A and FIG. 4A.

To accomplish an adjustment of the orientation of slats 4, the bead chain 6 will be pulled straight down, and then pulled outwards, whereupon the sleeve 62 will withdraw, spring 63 being compressed to bring the composite bevel gear 621 back out into engagement with bevel gear 44 on the orientation shaft 41, whereupon exertion of a pull, in one direction, or else in the opposite direction, will bring the slats to the orientation desired. All this is done quickly without incurring any inconvenience to the user, as can be better understood by referring to FIG. 3B and FIG. 4B. As the force bearing upon the bead chain 6 in the outgoing direction is relieved, it will go back to the previous actuation point prepared for further pivoting transmission to drapery 5.

In summary, the present invention makes possible integrated operation in a manner that is easy and convenient enough, of alternative switching adjustment of the drapery 5, and of the blind slats 4 embodied side by side on a composite Venetian blind/drapery shade structure.

I claim:

1. A semi-automatic shutter slat orientation adjustment and drape release control as applied in a double-layer composite window drape with Venetian blind shade comprising a broad piece of drapery for pendent layout of the window drape;

a plurality of slats of the Venetian blind shade;

a composite tringle including
two functionally correlated guideways;

a slat orientation adjustment shaft mounted movably in a middle, level section of one of said guideways of said tringle;

couplings spaced on said slat orientation adjustment shaft;

a plurality of trapezoidal lacings extending downward from said couplings abutting said plurality of slats;

a first bevel gear on said slat orientation adjustment shaft and movable therewith;

a drapery roller mounted movably in a middle, level section of the other of said guideways of said tringle on which is attached said broad piece of drapery for pendent layout;

a second bevel gear on said drapery roller and movable therewith;

a laterally mounted shaft mounted in a direction laterally to said guideways;

a sleeve mounted for longitudinal sliding motion on said laterally mounted shaft;

a composite duplex bevel gear mounted for sliding movement with said sleeve on said laterally mounted shaft;

said first bevel gear and said second bevel gear mounted in opposing relationship for engagement with opposing faces of said composite duplex bevel gear in different lateral positions of said composite duplex bevel gear and said sleeve;

a chain roller wheel having a chain extending downward on both sides of said wheel therefrom, with said roller wheel mounted for rotation on said laterally mounted shaft and connected for reciprocation with said sleeve on said laterally mounted shaft; spring means exerting a force for reciprocal movement of said roller wheel, said sleeve, and said composite duplex bevel gear;

said roller wheel movable in a reciprocating direction along said laterally mounted shaft against the force of said spring means by a pull on said chain at an angle away from the vertical direction of said chain when said chain is free hanging, for engagement of said composite duplex bevel gear with one of said first and second bevel gears;

said composite duplex bevel gear engaged with the other one of said first and second bevel gears by the force of said spring means without a pull on said chain at said angle;

said composite duplex bevel gear rotated by a downward pull on said chain which rotates said roller wheel and said sleeve connected to said composite duplex bevel gear and in turn rotates the one of said first and second bevel gears engaged with said composite duplex bevel gear.

2. The semi-automatic shutter slat orientation adjustment and drape release control as applied in a double-layer composite window drape with Venetian blind shade of claim 1 wherein said spring means is a compressible spring.

3. The semi-automatic shutter slat orientation adjustment and drape release control as applied in a double-layer composite window drape with Venetian blind shade of claim 1 wherein the pull on said chain is at an angle away from said drapery to engage said first bevel gear with said composite duplex bevel gear; and said spring means is a compressible spring.

4. The semi-automatic shutter slat orientation adjustment and drape release control as applied in a double-layer composite window drape with Venetian blind shade of claim 1 wherein said chain is a continuous bead chain and said roller wheel is shaped to receive the beads of said continuous bead chain.

* * * * *